United States Patent [19]

Della Greca et al.

[11] 4,079,594

[45] Mar. 21, 1978

[54] SYSTEM FOR THE SELF-COMPENSATED SINKING OF FLOATING STRUCTURES

[75] Inventors: Antonio Della Greca, Mestre; Vincenzo Di Tella, Coppella di Torre Gavetta; Paolo Minardi, Mestre, all of Italy

[73] Assignee: Tecnomare S.p.A., Italy

[21] Appl. No.: 769,528

[22] Filed: Feb. 17, 1977

Related U.S. Application Data

[63] Continuation of Ser. No. 543,343, Jan. 23, 1975, abandoned.

[30] Foreign Application Priority Data

Jan. 23, 1974 Italy ..... 19705 A/74

[51] Int. Cl.[2] ..... E02D 23/02

[52] U.S. Cl. ..... 61/87; 114/16 E

[58] Field of Search ..... 61/69, 87, 88, 89, 92, 61/97; 114/16 E, 125

[56] References Cited

U.S. PATENT DOCUMENTS

| | | | |
|---|---|---|---|
| 2,334,992 | 11/1943 | Crake | 61/89 |
| 2,525,955 | 10/1950 | Scott | 61/97 |
| 2,580,911 | 1/1952 | Harris | 61/97 |
| 3,114,344 | 12/1963 | Meade | 114/125 X |
| 3,845,634 | 11/1974 | Rosenberg et al. | 61/97 |

*Primary Examiner*—Paul R. Gilliam
*Assistant Examiner*—David H. Corbin
*Attorney, Agent, or Firm*—Morgan, Finnegan, Pine, Foley & Lee

[57] ABSTRACT

A system is provided for buoyantly supporting an offshore structure so that it may be floated to a location in a body of water and then permitted to sink to the bottom, which consists of self-stabilizing apparatus comprised of a set of floodable chambers disposed around a central axis and a generally horizontal distributor, located above the floodable chambers to supply water thereto, whose axis is parallel to the axis of the floodable chambers. The distributor consists of an inner chamber which is connected to a water supply, an outer chamber which is partitioned into a set of compartments that complement the floodable chambers and an annular wall between the inner chamber and the compartments permitting an overflow of water from the inner chamber to the respective compartments, and each compartment is connected to its diagonally opposite floodable chamber so that water flows from it to that floodable chamber.

2 Claims, 3 Drawing Figures

SYSTEM FOR THE SELF-COMPENSATED SINKING OF FLOATING STRUCTURES

This is a continuation of application Ser. No. 543,343 filed Jan. 23, 1975, now abandoned.

It is well known by those skilled in the art of setting up offshore structures that are buoyantly supported by floodable chambers so they are floated to a location where they are permitted to sink to the bottom, that it is necessary to control the flooding of the different chambers so that an appropriate trim will be maintained during the sinking phase and, in particular, during the phase of contact with the bottom.

In the following specification, we describe the prefered form of apparatus with which our invention can be practiced that is illustrated schematically in the accompanying drawings. It is to be understood that this is given by way of example, as modifications and variances thereof may be made without departing from the spirit of our invention as defined in the appended claims.

Figure 1:
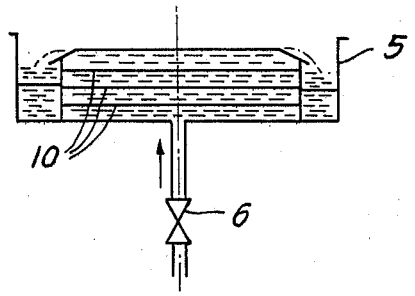
FIG. 1 is a vertical section of a distribution system having an axial symmetry in accordance with our invention.
Figure 2:
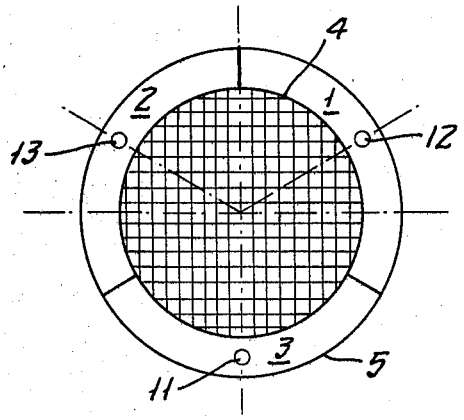
FIG. 2 is a plan view of the distribution system illustrated in FIG. 1.

The system consists essentially in ballasting with water or fluids two or more ballast tanks suitably arranged on the structure by means of a distributor consisting essentially of two concentric chambers 4 and 5 of which the outer one is partitioned into as many compartments as there are chambers to be ballasted (in the case of FIG. 1 outer chamber 5 is partitioned into three compartments 1, 2 and 3).

The feed of fluid to the central chamber 4 is through valve 6 which may act as a regulator of the flow of fluid through the system and therefore of the sinking speed. The presence of suitable filters 10 in central chamber 4 is to allow a flow uniformity in order to prevent the formation of preferential paths.

Figure 3:
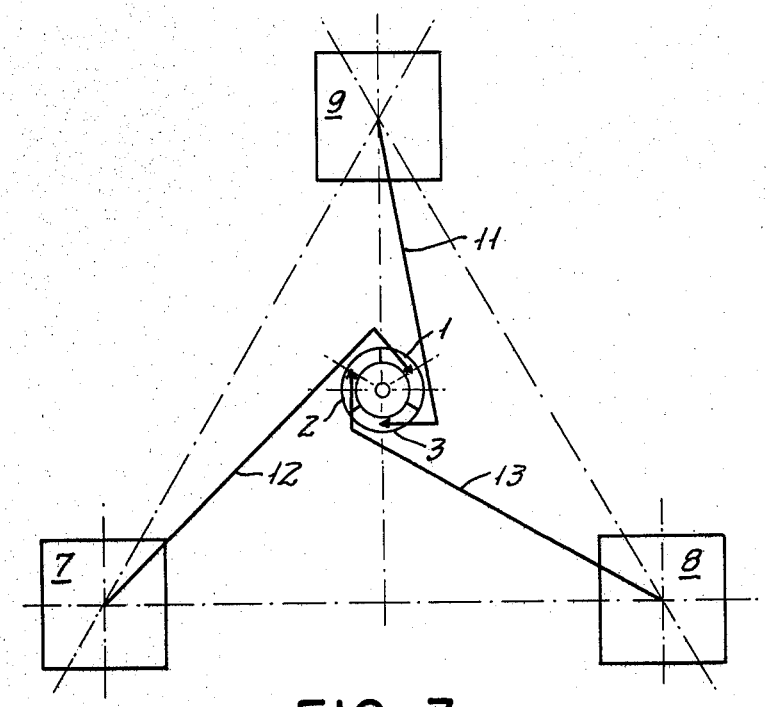
FIG. 3 is a plan view of a connecting arrangement between the distribution system of FIG. 1 and a plurality of floodable chambers.

The main feature of our invention is the connection of compartments 1, 2 and 3 with the flooding chambers diagonally opposite thereto with respect to the axis of symmetry of the distributing system; i.e. in the case of FIG. 3 compartment 3 is connected with chamber 9, through conduit 12 compartment 1 is connected with chamber 7 through conduit 12 and compartment 2 is connected with chamber 8 through conduit 13. Said connections between compartments 1, 2 and 3 and chambers 7, 8 and 9 are such that, if for any reason an excess flooding of one of the chambers causes the inclination of the structure beyond certain limits, the liquid overflow from central chamber 4 fills a compartment related to the flooding chamber having a deficient flooding, thereby causing the floating structure to right itself and sink along the vertical.

The choice of the size of the central chamber is a function of the flow of the system, making it possible to place a limit on the largest possible angle of inclination of the distribution system as it sinks.

It is clear that the number of the compartments in outer chamber 5 may be higher than three, this being a function of the number of the floodable chambers and of their geometry and within the scope of the invention.

What we claim is:

1. Self-stabilizing apparatus for buoyantly supporting an off-shore structure so that it may be floated to a location in a body of water and then permitted to sink vertically to the bottom, comprising:

a set of floodable chambers disposed around a central axis which when uniformly flooded will cause the structure to sink vertically to the bottom of the body of water; and a distributor located above the floodable chambers having a generally vertical axis, including:

a pair of concentric chambers separated by an overflow rim, a conduit connected to said inner chamber for supplying liquid thereto, a series of partitions in said outer chamber separating it into a set of compartments respectively complementing said floodable chambers and into which liquid will flow over said rim when said distributor is inclined towards a floodable chamber because of excessive flooding of that chamber relative to the other said chambers, and a set of conduits connecting said respective compartments to a diagonally opposite floodable chamber so that when liquid flows from said inner chamber over said rim into said inclined outer compartment, the liquid will flow to its diagonally opposite floodable chamber rather than the floodable chamber with excessive liquid, whereupon the structure will right itself and sink vertically to the bottom of the body of water.

2. Self-stabilizing apparatus for supporting an offshore structure as claimed in claim 1, wherein the generally vertical axis of the distributor is parallel to said central axis of the floodable chambers.

* * * * *